United States Patent [19]

Kidokoro

[11] Patent Number: 4,472,957

[45] Date of Patent: Sep. 25, 1984

[54] SECONDARY WORKING APPARATUS

[75] Inventor: Susumu Kidokoro, Fuji, Japan

[73] Assignee: Nissan Motor Company, Limited, Yokohama, Japan

[21] Appl. No.: 379,769

[22] Filed: May 19, 1982

[51] Int. Cl.[3] ..... B21H 5/00

[52] U.S. Cl. ..... 72/123; 72/125

[58] Field of Search ..... 409/8, 62; 82/1.2; 29/159.2; 72/107, 117, 120, 122, 123, 125

[56] References Cited

U.S. PATENT DOCUMENTS

| | | | |
|---|---|---|---|
| 1,740,792 | 12/1929 | Strachauer et al. | 72/117 |
| 2,556,742 | 6/1951 | Strickland | 10/120.5 R |
| 3,735,618 | 5/1973 | Zook | 72/100 |
| 3,803,896 | 4/1974 | Cermak et al. | 29/159.2 |

FOREIGN PATENT DOCUMENTS

| | | | |
|---|---|---|---|
| 519259 | 6/1976 | U.S.S.R. | 72/123 |

*Primary Examiner*—Lowell A. Larson

*Attorney, Agent, or Firm*—Lane, Aitken & Kananen

[57] ABSTRACT

A secondary working apparatus for secondarily machining a blank preliminarily formed with internal serrations, splines or teeth on a cylindrical plane, comprising a stationary housing structure; a chuck for supporting the blank with the center axis of the cylindrical plane fixed with respect to the housing structure; at least one shaft rotatable with respect to the housing structure about an axis substantially parallel with the center axis of the above mentioned cylindrical plane, the shaft having a cylindrical eccentric axial portion having a center axis offset from the axis of rotation of the shaft; and at least one generally cylindrical machining tool coaxially carried on the eccentric axial portion of the shaft and formed with a plurality of external serrations, the machining tool having a center axis substantially coincident with the center axis of the eccentric axial portion of the shaft.

7 Claims, 6 Drawing Figures

SECONDARY WORKING APPARATUS

FIELD OF THE INVENTION

The present invention relates to a secondary working apparatus for the secondary machining of a blank preliminarily formed with serrations, splines or teeth.

SUMMARY OF THE INVENTION

In accordance with the present invention, there is provided a secondary working apparatus for secondarily machining a blank preliminarily formed with internal serrations, splines or teeth on a cylindrical plane having a center axis therethrough. The internal serrations, splines or teeth as above mentioned of the blank to be machined by the secondary working apparatus proposed by the present invention will be hereinafter referred to as and represented by serrations. The secondary working apparatus according to the present invention comprises a stationary housing structure; support means for supporting the blank with the center axis of the cylindrical plane fixed with respect to the housing structure; at least one shaft rotatable with respect to the housing structure about an axis substantially parallel with the center axis of the above mentioned cylindrical plane, the shaft having a cylindrical eccentric axial portion having a center axis offset from the axis of rotation of the shaft; and at least one generally cylindrical machining tool coaxially carried on the eccentric axial portion of the shaft and formed with a plurality of external serrations, the machining tool having a center axis substantially coincident with the center axis of the eccentric axial portion of the shaft. The secondary working apparatus thus constructed and arranged basically in accordance with the present invention may further comprise a planetary gear assembly which comprises an internally toothed ring gear rotatable with respect to the housing structure about an axis substantially aligned with the center axis of the aforesaid cylindrical plane, an externally toothed sun gear coaxially encircled by the ring gear, at least one planet pinion held in mesh with the ring gear and the sun gear and rotatable with the shaft about the axis of rotation of the shaft, and a pinion carrier carrying the planet pinion and the shaft, one of the sun gear and the pinion carrier being rotatable about the axis of rotation of the ring gear. In this instance, the above mentioned support means may be constructed and arranged to be operative to have the blank fixedly held in position with respect to the housing structure, wherein the sun gear is rotatable with respect to the housing structure about the axis of rotation of the ring gear and the pinion carrier is rotatable with the ring gear about the axis of rotation of the ring gear so that the shaft and accordingly the machining tool carried on the shaft are rotatable with respect to the pinion carrier about the axis of rotation of the shaft and with respect to the housing structure about the common axis of rotation of the ring gear and the sun gear.

The secondary working apparatus according to the present invention may further comprise differential-speed drive means operative to drive the ring gear and sun gear of the planetary gear assembly for rotation with respect to the housing structure about the common axis of rotation thereof at speeds with a predetermined difference established therebetween. Such differential-speed drive means may comprise an externally toothed first driven gear rotatable about an axis aligned with the common axis of rotation of the ring gear and the sun gear of the planetary gear assembly, an externally toothed second driven gear axially spaced apart from the first driven gear and rotatable about an axis substantially aligned with the axis of rotation of the first driven gear, and an internally toothed drive gear coaxially encircling and held in mesh with both of the first driven gear and the second driven gear, the external teeth of each of the first and second driven gears being equal in diametral pitch to the internal teeth of the drive gear and being different in number from the external teeth of the other of the first and second driven gears.

BRIEF DESCRIPTION OF THE DRAWINGS

Drawbacks of a prior-art secondary working apparatus of the nature to which the present invention generally appertains and further details of a secondary working apparatus according to the present invention will be understood from the following description taken in conjunction with the accompanying drawings in which.

DESCRIPTION OF THE PRIOR ART

Figure 1:
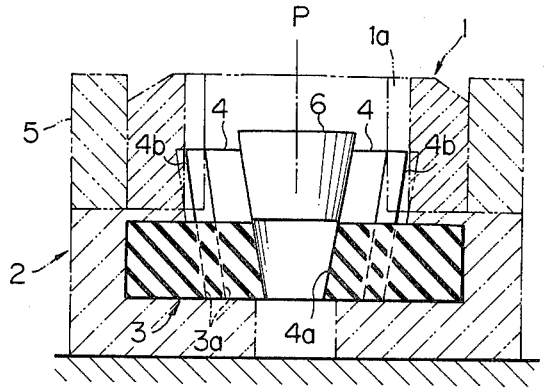
FIG. 1 PRIOR ART
FIG. 1 is a schematic cross sectional view of a known secondary working apparatus.

In FIG. 1 of the drawings is shown an example of a known secondary working apparatus. The prior-art secondary working apparatus herein shown is disclosed in Japanese Utility Model Publication No. 1,088,711 and is used for the secondary machining of a generally ring-shaped blank 1 of metal preliminarily formed with internal splines 1*a*. The secondary working apparatus comprises a cylindrical hollow casing 2 having closely enclosed therein a generally annular tool retainer block 3 of a resilient material such as rubber or a synthetic resin. The tool retainer block 3 is centrally formed with an axial bore 3*a* having a regularly echino-stelliform or denticularly stelliform cross section. A plurality of coining tool elements 4 are closely received each partially in this axial bore 3*a* of the tool retainer block 3 and are arranged symmetrically about the center axis of the bore 3*a*, forming a frusto-conical axial bore 4*a* which is tapered toward the bottom wall of the hollow casing 2. Each of the coining tool elements 4 has a cross section reduced outwardly in a radial direction of the retainer block 3 so that the coining tool elements 4 as a whole form external splines 4*b* which are also tapered toward the bottom wall of the casing 2.

For the secondary working of the blank 1 in the secondary working apparatus thus constructed, the blank 1 is fixedly held in position on the hollow casing 2 by means of a fixture 5 in such a manner that the center axis of the blank 1 is aligned with the center axis of the frusto-conical axial bore 4a formed by the coining tool elements 4 in the retainer block 3. A frusto-conical plunger 6 is then driven into the axial bore 4a as indicated by arrow P for expanding the bore 4a and thereby forcing the individual coining tool elements 4 outwardly in radial directions of the retainer block 3. Each of the coining tool elements 4 is consequently displaced with respect to the blank 1 outwardly in a radial direction of the retainer block 3 from the initial position indicated by full lines to a position indicated by phantom lines against the elasticity of the retainer block 3. It therefore follows that the external splines 4b formed by the individual coining tool elements 4 are forced into the spaces between the preliminarily formed internal splines 1a of the blank 1. The result is that the internal splines of the blank 1 are deformed into desired shapes.

A problem is encountered in a prior-art secondary working apparatus of the above described nature in that each of the internal splines 1a of the blank 1 is worked upon by a different two of the coining tool elements 4 and accordingly that the accuracy of the machining is dictated significantly by the dimensional accuracy of each tool element 4 and the accuracy with which the individual tool elements 4 are fitted into the retainer block 3. Because, furthermore, of the fact that the deformation of the internal splines 1a of the blank 1 is caused by a single stroke of the plunger 6, the splines 1a of the blank 1 are left with residual strains upon completion of the secondary working process. The present invention contemplates provision of an improved secondary working apparatus to solve these and other problems which have thus far been inherent in a prior-art secondary working apparatus of the described character.

DESCRIPTION OF THE PREFERRED EMBODIMENT

Figure 2:
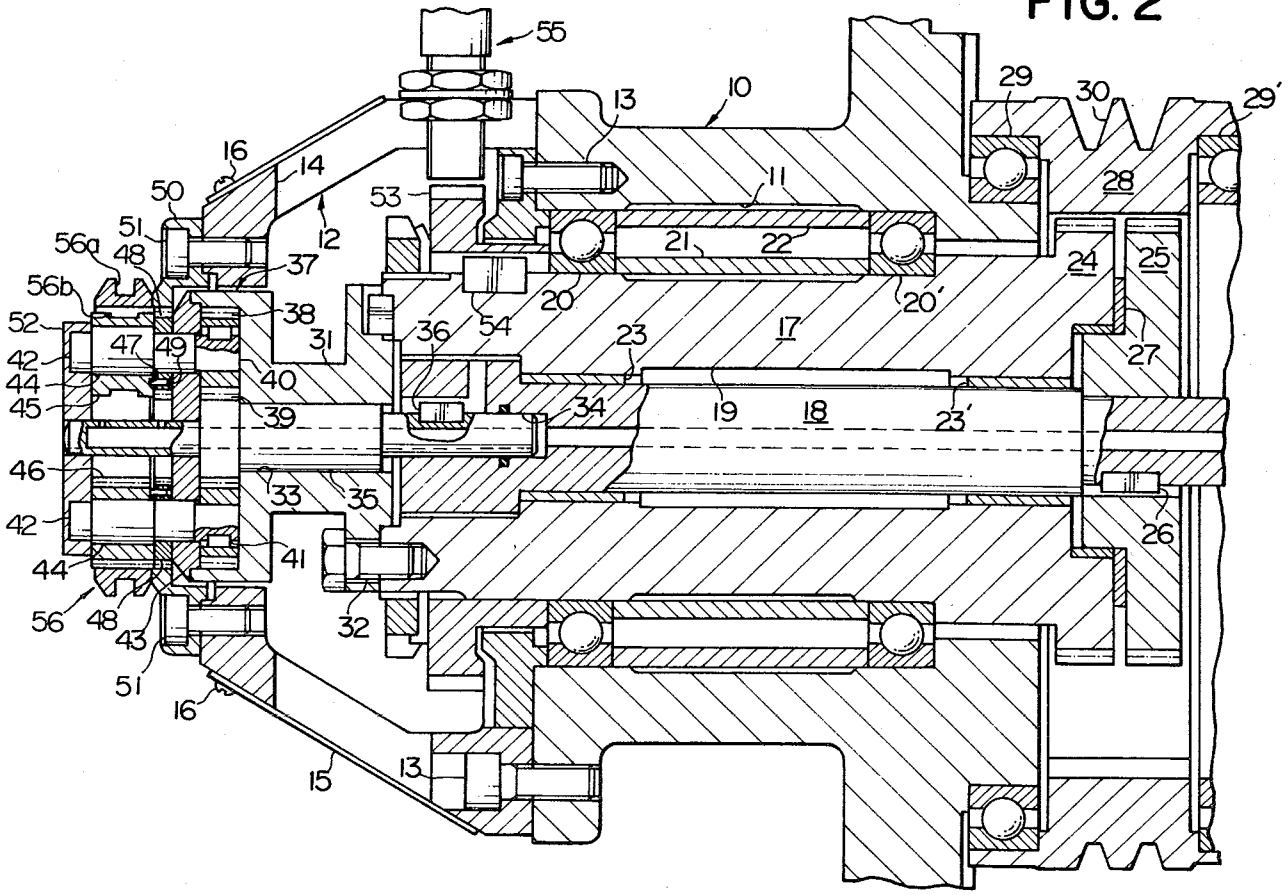
FIG. 2 is a longitudinal sectional view of a preferred embodiment of a secondary working apparatus according to the present invention.

Referring to FIG. 2 of the drawings, a preferred embodiment of a secondary working apparatus according to the present invention comprises a stationary housing structure including a housing shell 10 formed with a generally cylindrical axial bore 11 which is open at opposite ends thereof. The housing structure further includes a generally frusto-conical, hollow support member 12 which is securely connected to the housing shell 10 by suitable fastening means such as bolts 13 as shown and which is formed with an opening 14. To a reduced outer axial end portion of the support member 12 is fixedly attached a generally frusto-conical dust cover 15 also by suitable fastening means such as screws 16 as shown.

The secondary working apparatus according to the present invention further comprises differential-speed drive means adapted to produce a predetermined differential speed of revolution from a driving power with a given revolution speed. In the secondary working apparatus as herein shown, such differential-speed drive means comprises a hollow shaft 17 and a center shaft 18. The hollow shaft 17 axially extends through the bore 11 and is formed with an axial bore 19 coaxial with the bore 11. The center shaft 18 axially extends through the bore 19 and has a center axis coincident with the center axis of the hollow shaft 17 and accordingly with the center axis of the axial bore 11. The hollow shaft 17 has axial portions journaled in bearings 20 and 20' respectively received in internal wall portions of the housing shell 10 and is rotatable about the center axis of the center shaft 18 with respect to the housing shell 10. The bearings 20 and 20' are axially held in position on the hollow shaft 17 by means of cylindrical inner and outer spacer sleeves 21 and 22 axially intervening between the bearings 20 and 20' and coaxially surrounding an intermediate axial portion of the hollow shaft 17 as shown. The hollow shaft 17 is, furthermore, rotatably mounted on the center shaft 18 by means of a pair of cylindrical bushes 23 and 23' so that the hollow shaft 17 and the center shaft 18 are rotatable about the common center axis thereof with respect to each other and to the housing shell 10. The hollow shaft 17 axially extends beyond the inner axial end of the housing shell 10 and is connected to or has carried on an outer axial portion thereof an externally toothed first driven gear 24 having a center axis aligned with the common center axis of the shafts 17 and 18. The first driven gear 24 is herein shown as forming part of and accordingly being integral with the hollow shaft 17 but, if desired, may be constructed independently of the hollow shaft 17 and securely connected to the hollow shaft 17 in a suitable manner or by suitable fastening means. The first driven gear 24 is thus rotatable with the hollow shaft 17 about the common axis of the shafts 17 and 18 and is assumed to have an $n_1$ number of gear teeth. On the other hand, the center shaft 18 has an axial extension projecting outwardly from the inner axial end of the bore 19. The axial extension of the center shaft 18 is connected to or has carried thereon an externally toothed second driven gear 25 having a center axis aligned with an extension of the common center axis of the shafts 17 and 18. The second driven gear 25 is herein shown as being constructed independently of the center shaft 18 and keyed as at 26 to the axial extension of the center shaft 18 but, if desired, may be splined to the axial extension of the center shaft 18 or may be integral with the center shaft 18. The second driven gear 25 is thus rotatable about the extension of the common center axis of the shafts 17 and 18 and is assumed to have an $n_2$ number of gear teeth. Between the first and second driven gears 24 and 25 is interposed a collar bearing 27 holding the center shaft 18 in axial position with respect to the hollow shaft 17.

The differential-speed drive means of the secondary working apparatus embodying the present invention further comprises an internally toothed drive gear 28 having a pair of axially opposite flange portions respectively received on bearings 29 and 29' which are axially held in position on an inner axial end portion of the housing shell 10. The drive gear 28 is provided in coaxially encircling relationship to the above mentioned first and second driven gears 24 and 25 and are internally held in mesh with both of the gears 24 and 25. The external teeth of each of the first and second driven gears 24 and 25 are equal in diametral pitch (or "module" for metric gears) to the internal teeth of the drive gear 28 and, furthermore, the number $n_1$ of the teeth of the first driven gear 24 is different from, viz., smaller or larger by a predetermined integer than the number $n_2$ of the teeth of the second driven gear 25. In order that such gears 24 and 25 are permitted to be commonly in mesh with the drive gear 28 and to be nevertheless rotatable about a common axis coincident with the axis of rotation of the drive gear 28, and of the first and second driven gears 24 and 25 having the greater number of teeth is produced by cutting the teeth thereof with negatively shifted tooth profiles providing reduced outside diameters or addenda and/or the other of the first and second driven gears 24 and 25 having the smaller number of teeth is produced by cutting the teeth thereof with positively shifted tooth profiles providing increased outside diameters or addenda. If, thus, the respective numbers of the teeth of the first and second gears 24 and 25 are selected so that the number $n_2$ of the teeth of the second driven gear 25 is larger than the number $n_1$ of the teeth of the first driven gear 24, then the first driven gear 24 is produced by cutting the teeth thereof with positively shifted tooth profiles providing increased outside diameters or addenda and/or the second driven gear 25 is produced by cutting the teeth thereof with negatively shifted tooth profiles providing reduced outside diameters or addenda. For purposes of description, it is herein assumed that the number $n_1$ of the teeth of the first driven gear 24 is smaller than the number $n_2$ of the teeth of the second driven gear 25 and that the second driven gear 25 in particular is produced by cutting the teeth thereof with negatively shifted tooth profiles.

The first and second driven gears 24 and 25 and the drive gear 28 constitute in combination a gear train which is known as the Furgusson's mechanical paradox or "strange" gear train. When the drive gear 28 of such a gear train is driven for rotation at a certain speed about the center axis thereof, the two driven gears 24 and 25 are caused to rotate about the common center axis thereof at speeds which differ from each other by a value proportional to the difference between the respective numbers of teeth of the gears 24 and 25. If, thus, it is assumed by way of example that the number $n_1$ of the first driven gear 24 is 120 while the number $n_2$ of the second driven gear 25 is 121, the relative motion produced between the two gears 24 and 25 is such that the first driven gear 24 is caused to turn faster than the second driven gear 25 through an angle corresponding to one pitch, viz., the angle of rotation of 3 degrees corresponding to the 1/120 fraction of a full turn of the gear 24 each time the second driven gear 25 makes a full turn. The drive gear 28 forming part of such a gear train is operatively connected to a suitable driving source such as a reversible motor (not shown). For this purpose, the drive gear 28 has a grooved pulley 30 formed by an outer peripheral portion of the gear 28 per se as shown. The pulley 30 constitutes a driven pulley forming part of a belt and pulley mechanism which further comprises a driving pulley coupled to the driving source and an endless belt passed between the driving and driven pulleys, though not shown in the drawings. The driving source for such a belt and pulley arrangement is provided with suitable control means adapted to start and stop the driving source and to actuate the driving source for rotation in opposite directions in response to control signals supplied thereto during each cycle of operation of the secondary working apparatus.

The hollow shaft 17 axially extends slightly beyond the outer axial end of the housing shell 10 and is securely connected to a gear casing 31 by suitable fastening means such as bolts, one of which is indicated at 32. The gear casing 31 axially extends within the hollow support member 12 and is formed with an axial bore 33 having an center axis aligned with the the center axis of second driven gear 25. On the other hand, the center shaft 18 has formed in its outer end portion an axial bore 34 into which a gear shaft 35 axially extends. The gear shaft 35 is keyed as at 36 to or otherwise rotatable with the center shaft 18 and axially extends beyond the gear casing 31 through the bore 33 in the gear casing 31. The gear casing 31 and the gear shaft 35 are rotatable with the hollow shaft 17 and center shaft 18, respectively, about an extension of the common center axis of the shafts 17 and 18 and form part of a planetary gear assembly 37 to be driven by the shafts 17 and 18. For this purpose, the gear casing 31 has an internally toothed flange portion constituting a ring gear 38, while the gear shaft 35 has an externally toothed intermediate axial portion constituting a sun gear 39 coaxially encircled by the ring gear 38, as will be better seen from FIG. 3 of the drawings. The ring gear 38 and the sun gear 39 have a common axis of rotation aligned with the common center axis of the first and second driven gears 24 and 25. The planetary gear assembly 37 further comprises four externally toothed planet pinions 40 which are arranged symmetrically about the common axis of rotation of the ring and sun gears 38 and 39. Each of the planet pinions 40 intervenes between the ring and sun gears 38 and 39 and is held in mesh with the ring gear 38 and with the sun gear 39. The planet pinions 40 are keyed as at 41 to or otherwise coaxially rotatable with pinion shafts 42, respectively, each of which has a circular cross section and an axis of rotation parallel with the common axis of rotation of the ring and sun gears 38 and 39. The individual pinion shafts 42 are connected together by means of a pinion carrier 43 formed with openings through which the pinion shafts 42 axially extend outwardly, viz., in directions opposite to the gear casing 31. The pinion carrier 43 is securely coupled to the flange portion of the gear casing 31 and accordingly to the ring gear 38 by suitable fastening means. The pinion shafts 42 and the planet pinions 40 are thus not only individually rotatable about the respective axes of rotation of the pinion shafts 42 with respect to the pinion carrier 43 but also together with the ring gear 38 about the common axis of rotation of the ring and sun gears 38 and 39 with respect to the sun gear 39 and the support member 12 forming part of the housing structure. The ring gear 38, sun gear 39 and planet pinions 40 are axially held in position between the pinion carrier 43 and an annular disc portion of the gear casing 31. The gear shaft 35 has an axial extension projecting outwardly through a central opening formed in the pinion carrier 43.

Figure 4:
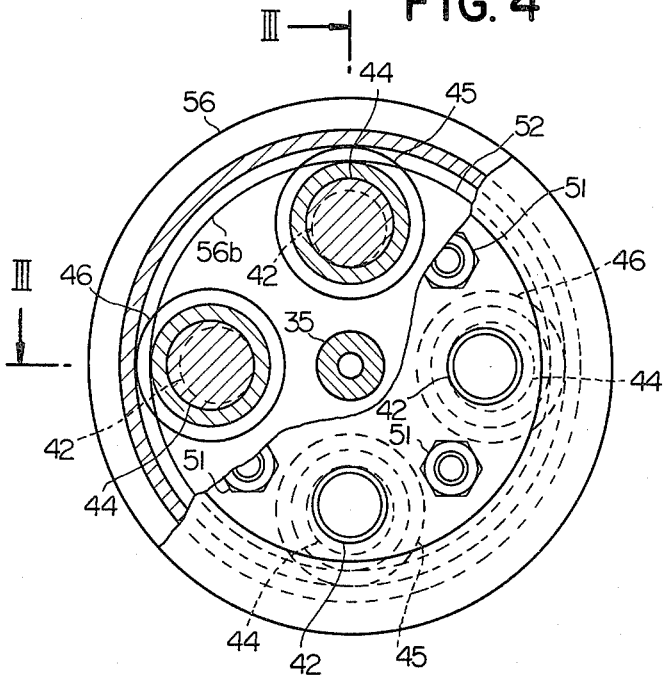
FIG. 4 is an end view showing, partially in cross section, of the secondary working apparatus shown in FIG. 2, the sectional view of FIG. 3 being taken on planes indicated by lines III—III in FIG. 4.
Figure 5:
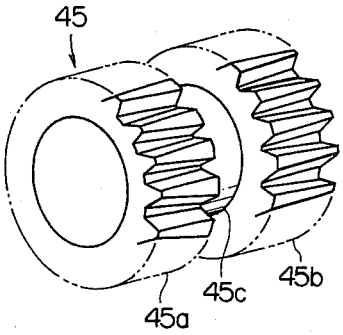
FIG. 5 is a perspective view showing a coining tool included in the secondary working apparatus illustrated in FIGS. 2 to 4.
Figure 6:
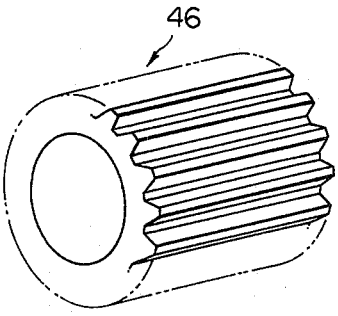
FIG. 6 is a perspective view showing a finishing tool also included in the secondary working apparatus shown in FIGS. 2 to 4.

Each of the pinion shafts 42 axially projects outwardly from the openings in the pinion carrier 43 and has a cylindrical, eccentric axial portion 44 having a center axis offset from the axis of rotation of the pinion shaft 42 as will be better seen from FIG. 4. The respective eccentric axial portions 44 of each pair of pinion shafts 42 diametrically opposite to each other across an extension of the common axis of rotation of the ring and sun gears 38 and 39 have circular cross sections symmetric to each other with respect to the extension of the common axis of rotation of the gears 38 and 39 as will also be seen from FIG. 4. One pair of diametrically opposite pinion shafts 42 have further carried thereon generally spool-shaped coining tools 45 having smooth inner peripheral surfaces slidably received on the outer peripheral surfaces of the eccentric axial portions 44 of the pinion shafts 42, respectively. Likewise, the other pair of diametrically opposite pinion shafts 42 have further carried thereon generally cylindrical finishing tools 46 having smooth inner peripheral surfaces slidably received on the outer peripheral surfaces of the eccentric axial portions 44 of the pinion shafts 42, respectively. As will be better seen from FIG. 5 of the drawings, each of the coining tools 45 has a pair of generally cylindrical, externally serrated axial land portions **45*a* and 45*b* which are axially spaced apart from each other to form a circumferential groove 45*c* therebetween. The external serrations of each of the land portions 45***a* and 45*b* axially extend throughout the length of the land portion and are axially aligned with the external serrations of the other land portion. As will be seen from FIG. 6 of the drawings, on the other hand, each of the finishing tools 46 is also externally serrated axially of the finishing tool 46 throughout the length of the tool. Each of the coining tools 45 and finishing tools 46 is slidable on the outer peripheral surface of the eccentric axial portion 44 of each of the pinion shafts 42 about the center axis of the eccentric axial portion 44 and is rotatable with the axial portion 44 about the axis of rotation of the pinion shaft 42 with respect to the pinion carrier 43. As will be best seen from FIG. 3, each of the coining tools 45 and finishing tools 46 is formed with a radial slot 47 extending in a radial direction of the coining tools 45 or finishing tool 46 and axially open toward the pinion carrier 43.

Figure 3:
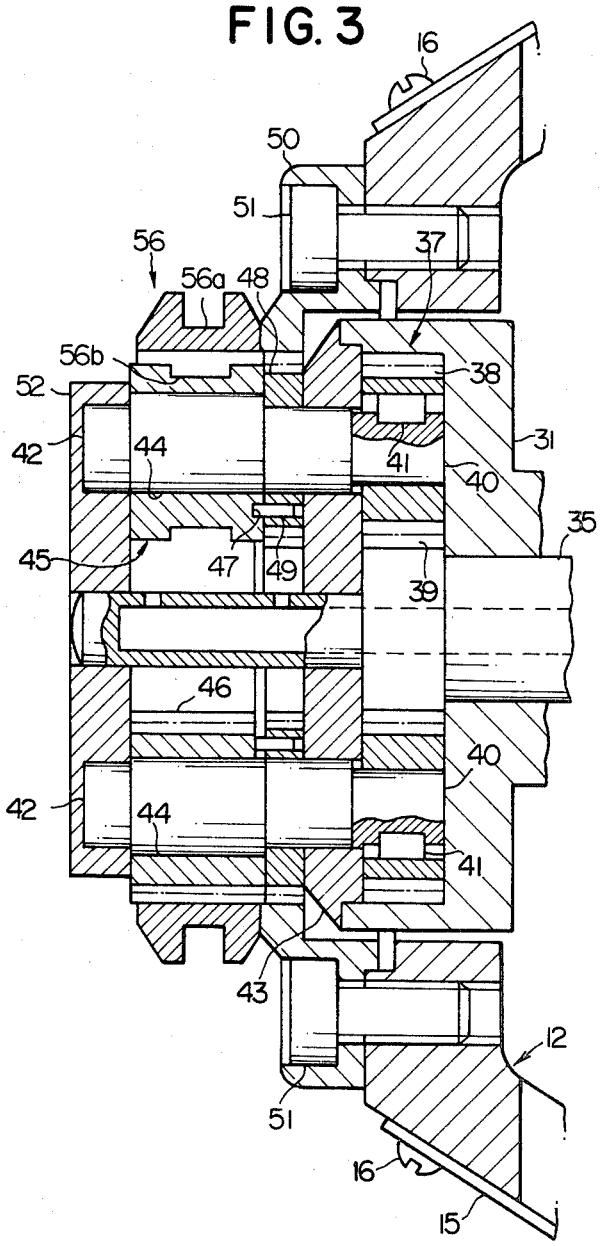
FIG. 3 is a sectional view showing, to an enlarged scale, portions of the embodiment illustrated in FIG. 2.

Each of the pinion shafts 42 has two concentric axial portions extending in opposite directions from the eccentric axial portion 44 thereof and having respective center axes coincident with the axis of rotation of the pinion shaft 42. One concentric axial portion of each pinion shaft 42 extends through each of the openings in the pinion carrier 43 into the planet pinion 40. Each of these concentric axial portions of the individual pinion shafts 42 has slidably mounted thereon a ring-shaped, externally serrated locating pinion 48 which is located axially between the pinion carrier 43 and the coining tool 45 or finishing tool 46. The locating pinion 48 has a guide pin 49 projecting from one end face of the locating pinion 48 in a direction parallel with the axis of rotation of the pinion shaft 42 having the locating pinion 48 carried thereon. The guide pin 49 axially extends into the above mentioned radial slot 47 in the coining tool 45 or finishing tool 46 on the pinion shaft 42 so that the coining or finishing tool 45 or 46 and the locating pinion 48 on each of the pinion shafts 42 are rotatable together on the particular pinion shaft 42. With the guide pin 49, the external serrations of the locating pinion 48 are axially aligned with the external serrations, respectively, of the coining tool 45 or finishing tool 46. As the coining tool 45 or finishing tool 46 is rotated on the outer peripheral surface of the eccentric axial portion 44 of the pinion shaft 42 about the center axis of the eccentric axial portion 44, the locating pinion 48 is caused to rotate on the outer peripheral surface of the concentrical axial portion of the pinion shaft 42 about the axis of rotation of the pinion shaft 42. As the locating pinion 48 is turned on the pinion shaft 42, the guide pin 49 is displaced outwardly or inwardly in the slot 47 in the coining tool 45 or finishing tool 46 in a radial direction of the coining or finishing tool 45 or 46. The respective locating pinions 48 are externally held in mesh with an internally serrated stationary locating gear 50 securely connected to the housing structure by suitable fastening means such as bolts 51 which are screwed to the support member 12 as shown in FIGS. 2 and 3. The other concentric axial portions of the pinion shafts 42 constitute journal portions received in a retaining end plate 52 which is securely connected to or integral with the pinion carrier 43 of the planetary gear assembly 37 and which is formed with openings respectively having the journal portions of the pinion shafts 42 rotatably received therein. The retaining end plate 52 is further formed with a central opening into which the axial extension of the gear shaft 35 is rotatably received. The eccentric axial portions 44 of the pinion shafts 42 and the coining tools 45 and finishing tools 46 on the eccentric axial portions 44 are located axially between the stationary locating gear 50 and the retaining end plate 52.

Turning back to FIG. 2, the hollow shaft 17 has mounted thereon a spur gear 53 which is keyed as at 54 to the shaft 17 and which is accordingly rotatable with the hollow shaft 17 about the center axis of the shaft 17. The gear 53 forms part of rotation-angle detecting means adapted to detect the angle through which the hollow shaft 17 and accordingly the pinion carrier 43 and each of the coining tools 45 and finishing tools 46 are caused to turn about the aligned center axes of the center shaft 18 and the gear shaft 35 with respect to the housing structure. Such rotation-angle detecting means thus further comprises a suitable pick-up unit 55 mounted on the housing shell 10 and located in conjunction with the arcuate path of the teeth of the gear 53 as shown. The pick-up unit 55 is responsive to the passage of the teeth of the gear 53 through a predetermined zone adjacent the pick-up unit 55 and is operative to produce signals indicative of the number of the gear teeth passed through such a zone after the hollow shaft 17 has been initiated into motion to drive the coining tools 45 and the sun gear 39 for rotation about the center axis of the center shaft 18 during each cycle of operation of the apparatus.

The secondary working apparatus embodying the present invention as hereinbefore described with reference to FIGS. 2 to 6 is assumed, by way of example, as being designed to be used for the secondary working of a generally ring-shaped blank which has been preliminarily forged or otherwise worked roughly in the form of a synchronizer clutch sleeve for use in a manually-operated synchromesh power transmission mechanism for an automotive vehicle. As shown in FIGS. 2, 3 and 4 of the drawings, the ring-shaped blank thus worked roughly in the form of a synchronizer clutch sleeve is denoted by reference numeral 56 and is formed with an external circumferential groove 56*a* to be fitted by a gear shifting lever (not shown) and a multiplicity of internal splines 56*b*. Each of the internal splines 56*b* of such a blank extends substantially straight axially of the blank and is to be ultimately worked or coined into a spline tooth having counter-wedged opposite end portions. Thus, each of the external serrations or spline teeth which each of the hereinbefore mentioned coining tools 45 has on the two land portions 45*a* and 45*b* thereof has opposite end portions which are reduced toward the outer axial ends of the land portions as will be seen from FIG. 5. Accordingly, the axial groove formed between every adjacent two of the serrations or spline teeth of each land portion of each of the coining tools 45 is enlarged in counter-wedged form toward the outer axial ends of the land portions 45*a* and 45*b* as will also be seen from FIG. 5. The external serrations of the land portions 45*a* and 45*b* of each coining tool 45 and the external serrations of each finishing tool 46 are identical in number to the internal splines 56*b* of the blank 56 which is to be ultimately worked into the form of such a synchronizer clutch sleeve. The internal serrations of the previously mentioned stationary locating gear 50 are also identical in number to the internal splines 56*b* of the blank 56.

For the secondary working of the blank 56 in the secondary working apparatus embodying the present invention, the blank 56 is first fitted to the coining tools 45 and finishing tools 46 and is thereafter fixedly held in position with respect to the housing structure with use of a suitable clamping or gripping device such as, for example, a chuck (not shown). The driving source for the belt and pulley arrangement including the grooved pulley 30 (FIG. 2) is then put into operation driving the pulley 30 for rotation about the aligned axes of rotation of the first driven gear 24 and second driven gear 25. The driving power thus transmitted to the pulley 30 and accordingly to the drive gear 28 integral therewith is imparted to the first driven gear 24 and the second driven gear 25 through the engagement between the drive gear 28 and the first driven gear 24 and the engagement between the drive gear 28 and the second driven gear 25. As a consequence, the first driven gear 24 and second driven gear 25 are driven for rotation about the aligned center axes thereof with respect to the housing shell 10 at speeds with a predetermined difference corresponding to, for example, a full turn per 120 turns of the first driven gear 24 as previously noted. Such differential motions of the first driven gear 24 and second driven gear 25 are transmitted through the hollow shaft 17 and the center shaft 18 and further by way of the gear casing 31 and gear shaft 35 to the ring gear 38 and the sun gear 39, respectively, of the planetary gear assembly 37 and thereby produce a differential speed of rotation between the ring gear 38 and the sun gear 39 about the common center axis thereof. Since, in this instance, the first driven gear 24 and accordingly the ring gear 38 are driven for rotation at speeds higher than the speeds of rotation of the second driven gear 25 and accordingly the sun gear 39, there is produced between the ring gear 38 and the sun gear 39 of the planetary gear assembly 37 a relative rotary motion which is such that the ring gear 38 appears to be rotating with respect to the sun gear 39 in the direction of rotation of the ring gear 38. It therefore follows that the pinion carrier 43 fastened to the ring gear 38 and accordingly the pinion shafts 42 carried by the pinion carrier 43 are caused to turn about the common axis of rotation of the ring gear 38 and sun gear 39 with respect to the sun gear 39. As the pinion carrier 43 and the pinion shafts 42 thus turn about the common center axis of the ring gear 38 and the sun-gear 39 of the planetary gear assembly 37, the respective planet pinions 40 on the individual pinion shafts 42 are caused to turn coaxially with the pinion carrier 43 and the pinion shafts 42 and are caused to roll on the sun gear 39 with respect to which the pinion carrier 43 and the pinion shafts 42 are rotating. The result is that each of the planet pinions 40 and accordingly the pinion shaft 42 is caused to turn not only with respect to the sun gear 39 about the common axis of rotation of the ring gear 38 and the sun gear 39 but further with respect to the pinion carrier 43 about the center axis of the planet pinion 40 per se. The rotation of each of the pinion shafts 42 about the center axis thereof with respect to the pinion carrier 43 results in revolution of the center axis of the eccentric axial portion 44 of the shaft 42 so that the coining tools 45 and finishing tools 46 respectively carried on the eccentric axial portions 44 of the pinion shafts 42 are caused to turn about the respective center axes of the pinion shafts 42 while turning about the common axis of rotation of the pinion shafts 42. The individual coining tools 45 and finishing tools 46 are thus caused to roll on the blank 56 which is fixedly held in position with respect to the housing structure. As a result of the rolling motion of the coining tools 45, the individual external serrations of the land portions 45*a* and 45*b* of each of the coining tools 45 are forced deeper in succession into the spaces between the internal splines 56*b* of the blank 56 outwardly in radial directions of the blank 56 due to the eccentricity of the coining tool 45 with respect to the pinion shaft 42. The external serrations of each coining tool 45 being thus forced deeper into the spaces between the individual internal splines 56*b* of the blank 56, each of the splines 56*b* of the blank 56 is forcefully pressed upon between neighboring two of the external serrations of the coining tool 45 and is, as a consequence, shaped and sized, or coined, conformingly to the space between the two serrations of the coining tool 45. As the coining tools 45 are thus turning on the blank 56, the individual external serrations of each of the finishing tools 46 are also forced deeper in succession into the spaces between the internal splines 56*b* of the blank 56 outwardly in radial directions of the blank 56. The external serrations of each finishing tool 46 being thus forced deeper into the spaces between the individual internal splines 56*b* of the blank 56, each of the serrations is caused to slide on the opposite faces of neighboring two of the internal splines 56*b* of the blank 56, which is as a consequence finished and cleared of the flashes produced when the blank 56 is worked by the coining tools 45 as above described.

As the eccentric axial portions 44 of the pinion shafts 42 and accordingly the coining tools 45 and finishing tools 46 thereon turn commonly about the center axis of the blank 56 and individually about the respective center axes of the pinion shafts 42, the center axis of each of the eccentric axial portions 44 the pinion shafts 42 is caused to turn about the axis of rotation of the pinion shaft 42 as a whole so that the center axis of each eccentric axial portion 44 and accordingly the center axis of the coining tool 45 or finishing tool 46 carried on the eccentric axial portion 44 are displaced between locations respectively remotest from and closest to the splined inner perimeter of the blank 56. The distance of displacement between these two locations of the common center axis of the eccentric axial portion 44 of the pinion shaft 42 and the coining tool 45 or finishing tool 46 on the eccentric axial portion 44 is dictated by the amount of eccentricity between the axis of rotation of each of the pinion shafts 42 and the center axis of the eccentric axial portion 44 of each pinion shaft 42. Furthermore, the amount of displacement of the common center axis of the eccentric axial portion 44 of each pinion shaft 42 and the coining tool 45 or finishing tool 46 on each pinion shaft 42 with respect to the blank 56 is dependent upon the angle through which the sun gear 39 is caused to turn with respect to the ring gear 38, viz., the angle of rotation of the hollow shaft 17 with respect to the center shaft 18. The amount of displacement of the center axis of each of the coining tools 45 and finishing tools 46 with respect to the blank 56 can therefore be detected through detection of the angular position of the hollow shaft 17 with respect to the center shaft 18. Since, in this instance, the hollow shaft 17 and the center shaft 18 are driven at speeds with a predetermined difference established therebetween, the angular position of the hollow shaft 17 with respect to the center shaft 18 can be detected through detection of the angle through which the hollow shaft 17 is driven for rotation about the center axis thereof with respect to the housing structure. The pick-up unit 55 of the previously mentioned rotation-angle detecting means is thus adapted to detect such an angle by counting the number of those teeth of the spur gear 53 which have passed through the predetermined zone adjacent the pick-up unit 55. When the hollow shaft 17 is turned through a predetermined angle from the initial angular position thereof with respect to the housing structure and accordingly a predetermined number of teeth of the gear 53 is counted by the pick-up unit 55, a control signal is fed from the pick-up unit 55 to the control means of the driving source for the belt and pulley arrangement so as to actuate the driving source to drive the pulley 30 for rotation in a reverse direction until the hollow shaft 17 restores the initial angular position thereof with respect to the housing structure.

What is claimed is:

1. A secondary working apparatus for secondarily machining a blank preliminarily formed with internal serrations on a cylindrical plane having a center axis therethrough, comprising a stationary housing structure;

support means for supporting the blank with the center axis of said cylindrical plane fixed with respect to the housing structure;

at least one shaft rotatable with respect to said housing structure about an axis substantially parallel with the center axis of said cylindrical plane, the shaft having a cylindrical eccentric axial portion having a center axis offset from the axis of rotation of the shaft;

at least one generally cylindrical machining tool coaxially carried on the eccentric axial portion of the shaft and formed with a plurality of external serrations, the machining tool having a center axis substantially coincident with the center axis of said eccentric axial portion; and a planetary gear assembly which comprises an internally toothed ring gear rotatable with respect to said housing structure about an axis substantially aligned with the center axis of said cylindrical plane, an externally toothed sun gear coaxially encircled by the ring gear, at least one planet pinion held in mesh with the ring gear and the sun gear and rotatable with said shaft about the axis of rotation of the shaft, and a pinion carrier carrying said planet pinion and said shaft, one of said sun gear and said pinion carrier being rotatable about the axis of rotation of said ring gear.

2. A secondary working apparatus as set forth in claim 1, in which said support means is operative to have said blank fixedly held in position with respect to said housing structure, wherein said sun gear is rotatable with respect to said housing structure about the axis of rotation of said ring gear and said pinion carrier is rotatable with said ring gear about the axis of rotation of the ring gear so that said shaft and accordingly the machining tool carried on the shaft are rotatable with respect to said pinion carrier about the axis of rotation of the shaft and with respect to said housing structure about the common axis of rotation of said ring gear and said sun gear.

3. A secondary working apparatus as set forth in claim 2, in which said planet pinion is one of at least two planet pinions each intervening between the ring gear and the sun gear of said planetary gear assembly and in which said shaft is one of shafts respectively carried on said planet pinions, said planet pinions being connected together by said pinion carrier, said machining tool being one of machining tools mounted on the eccentric axial portions of said shafts, respectively, and consisting of a coining tool and a finishing tool.

4. A secondary working apparatus as set forth in claim 2 or 3, further comprising differential-speed drive means operative to drive the ring gear and the sun gear of said planetary gear assembly for rotation with respect to said housing structure about the common axis of rotation thereof at speeds with a predetermined difference established therebetween.

5. A secondary working apparatus as set forth in claim 4, in which said differential-speed drive means comprises an externally toothed first driven gear rotatable about an axis substantially aligned with the common axis of rotation of the ring gear and the sun gear of said planetary gear assembly, an externally toothed second driven gear axially spaced apart from the first driven gear and rotatable about an axis substantially aligned with the axis of rotation of the first driven gear, and an internally toothed drive gear coaxially encircling and held in mesh with both of the first driven gear and the second driven gear, the external teeth of each of the first and second driven gears being equal in diametral pitch to the internal teeth of the said drive gear and being different in number from the external teeth of the other of the first and second driven gears.

6. A secondary working apparatus as set forth in any one of claims 1 to 3, further comprising at least one, externally serrated annular locating pinion coaxially mounted on said shaft and rotatable on the shaft about the axis of rotation of the shaft and together with said machining tool with respect to said housing structure, and a stationary locating gear formed with internal serrations equal in number to the internal serrations of the blank and held in mating engagement with the external serrations of said locating pinion.

7. A secondary working apparatus as set forth in claim 4, further comprising at least one, externally serrated annular locating pinion coaxially mounted on said shaft and rotatable on the shaft about the axis of rotation of the shaft and together with said machining tool with respect to said housing structure, and a stationary locating gear formed with internal serrations equal in number to the internal serrations of the blank and held in mating engagement with the external serrations of said locating pinion.

* * * * *